US010244919B2

(12) United States Patent
Pers et al.

(10) Patent No.: US 10,244,919 B2
(45) Date of Patent: Apr. 2, 2019

(54) DETECTING OPERATIONAL STATE OF A DISHWASHER

(71) Applicant: ELECTROLUX HOME PRODUCTS CORPORATION N. V., Brussels (BE)

(72) Inventors: Per-Erik Pers, Järfälla (SE); Petter Svanbom, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 81 days.

(21) Appl. No.: 14/439,351

(22) PCT Filed: Nov. 8, 2012

(86) PCT No.: PCT/EP2012/072203
§ 371 (c)(1),
(2) Date: Apr. 29, 2015

(87) PCT Pub. No.: WO2014/071980
PCT Pub. Date: May 15, 2014

(65) Prior Publication Data

US 2015/0305592 A1 Oct. 29, 2015

(51) Int. Cl.
*A47L 15/00* (2006.01)
*A47L 15/42* (2006.01)

(52) U.S. Cl.
CPC ..... *A47L 15/4244* (2013.01); *A47L 15/0023* (2013.01); *A47L 15/0049* (2013.01); *A47L 15/4289* (2013.01); *A47L 2301/04* (2013.01); *A47L 2401/03* (2013.01); *A47L 2401/08* (2013.01); *A47L 2501/05* (2013.01);
(Continued)

(58) Field of Classification Search
None
See application file for complete search history.

(56) References Cited

U.S. PATENT DOCUMENTS 4,097,307 A 6/1978 Geiger
5,284,523 A 2/1994 Badami et al.
(Continued)

FOREIGN PATENT DOCUMENTS

CN 1 567 109 A 1/2005
CN 1909822 A 2/2007
(Continued)

OTHER PUBLICATIONS

Office Action from corresponding European Patent Application No. 12805601.7 dated Sep. 23, 2016.
(Continued)

*Primary Examiner* — Spencer E Bell
(74) *Attorney, Agent, or Firm* — Alston & Bird LLP

(57) ABSTRACT

The present invention relates to a method of and a device (40) for, detecting an operational state of a dishwasher (10), in particular activation of extra wash zones and overfill situations. The device (40) is arranged to operate a motor (22) driving a dishwasher circulation pump (21) at at least one rotational speed differing from a nominal rotational speed and measure operating current of the motor (22) driving the dishwasher circulation pump (21). Further, the device is arranged to determine whether the dishwasher (10) operates in an operational state differing from a nominal operational state based on the measured circulation pump motor operating current.

12 Claims, 4 Drawing Sheets

(52) U.S. Cl.
CPC ..... *A47L 2501/26* (2013.01); *A47L 2501/30* (2013.01); *A47L 2501/34* (2013.01)

(56) References Cited

U.S. PATENT DOCUMENTS

| | | | | |
|---|---|---|---|---|
| 5,330,580 | A | 7/1994 | Whipple, III et al. | |
| 6,655,922 | B1 | 12/2003 | Flek | |
| 6,887,318 | B2 | 5/2005 | Bashark | |
| 7,064,514 | B2 | 6/2006 | Iwaji et al. | |
| 7,064,517 | B2 | 6/2006 | Kiuchi et al. | |
| 7,241,347 | B2 | 7/2007 | Elick et al. | |
| 7,776,159 | B2 | 8/2010 | Hooker et al. | |
| 7,789,968 | B2 | 9/2010 | Elick et al. | |
| 8,295,984 | B2 | 10/2012 | Heisele et al. | |
| 8,439,052 | B2 | 5/2013 | Klein | |
| 9,872,597 | B2 | 1/2018 | Pers et al. | |
| 2001/0017145 | A1 | 8/2001 | Rosenbauer et al. | |
| 2003/0034749 | A1 | 2/2003 | Zinke et al. | |
| 2004/0099287 | A1 | 5/2004 | Shin | |
| 2005/0005952 | A1 | 1/2005 | Bashark | |
| 2006/0219262 | A1 | 10/2006 | Peterson et al. | |
| 2006/0237048 | A1 | 10/2006 | Weaver et al. | |
| 2007/0151579 | A1 | 7/2007 | Hooker et al. | |
| 2007/0163626 | A1 | 7/2007 | Klein | |
| 2007/0181156 | A1 | 8/2007 | Uz et al. | |
| 2010/0275953 | A1 | 11/2010 | Orue Orue et al. | |
| 2011/0038736 | A1 | 2/2011 | Hesterberg et al. | |
| 2011/0048459 | A1 | 3/2011 | Hesterberg et al. | |
| 2011/0126863 | A1* | 6/2011 | Kranzle | A47L 15/4221 134/25.2 |
| 2012/0000535 | A1* | 1/2012 | Poyner | A47L 15/0049 137/1 |
| 2012/0006355 | A1 | 1/2012 | Heidel et al. | |
| 2012/0048302 | A1 | 3/2012 | Didat | |
| 2012/0048314 | A1* | 3/2012 | Vitan | A47L 15/4225 134/56 R |
| 2012/0060874 | A1 | 3/2012 | Gnadinger et al. | |
| 2012/0266919 | A1 | 10/2012 | Kranzle et al. | |
| 2013/0048025 | A1 | 2/2013 | Heidel et al. | |

FOREIGN PATENT DOCUMENTS

| | | | |
|---|---|---|---|
| DE | 197 50 266 | A1 | 5/1999 |
| DE | 10 2004 022 682 | B3 | 3/2006 |
| DE | 102007041313 | | 3/2009 |
| DE | 10 2007 052 091 | A1 | 5/2009 |
| DE | 10 2008 020 475 | A1 | 11/2009 |
| DE | 10 2008 029 910 | A1 | 12/2009 |
| DE | 10 2011 000 287 | A1 | 7/2012 |
| DE | 102011003688 | | 8/2012 |
| DE | 10 2014 105527 | B3 | 4/2015 |
| EP | 0326 893 | A2 | 8/1989 |
| EP | 1 112 016 | A1 | 7/2001 |
| EP | 1284540 | A2 | 2/2003 |
| EP | 1 574 161 | A1 | 9/2005 |
| EP | 1 737 332 | A1 | 1/2007 |
| EP | 2 213 217 | A1 | 8/2010 |
| EP | 2 248 935 | A1 | 11/2010 |
| EP | 2 407 078 | A2 | 1/2012 |
| EP | 2 609 845 | A1 | 7/2013 |
| EP | 2672875 | | 12/2013 |
| JP | H 02302239 | A | 12/1990 |
| JP | H 05 115414 | A | 5/1993 |
| JP | H 0819506 | A | 1/1996 |
| JP | 2006 006 766 | A | 1/2006 |
| JP | 2011 143 130 | | 7/2011 |
| KR | 10-2012-0022427 | | 3/2012 |
| WO | WO 2005/070275 | A1 | 8/2005 |
| WO | WO 2005/089621 | A1 | 9/2005 |
| WO | WO 2006/116433 | A1 | 11/2006 |
| WO | WO2008125482 | | 10/2008 |
| WO | WO 2009/027371 | A1 | 3/2009 |
| WO | WO 2009/068391 | A1 | 6/2009 |
| WO | WO 2009/156326 | A2 | 12/2009 |
| WO | WO 2012/107264 | A1 | 8/2012 |
| WO | WO 2012/146599 | A2 | 11/2012 |
| WO | WO 2014/005650 | A1 | 1/2014 |
| WO | WO 2014/106801 | A1 | 7/2014 |

OTHER PUBLICATIONS

Office Action from U.S. Appl. No. 14/439,346 dated Aug. 31, 2016.
International Search Report for PCT/EP2012/072203 dated Aug. 28, 2013.
Office Action for U.S. Appl. No. 14/439,346 dated Dec. 5, 2016.
EPO machine translation of WO2005070275 retrieved from https://worldwide.espacenet.com/publicationDetails/biblio?CC=WO&NR=2005070275A1&KC=A1&FT=D&ND=3&date=20050804&DB=&locale=en_EP on Nov. 28, 2016.
Office Action for Chinese Application No. 201280076924.9 dated Oct. 10, 2016.
Office Action from corresponding European Patent Application No. 12805600.9 dated Feb. 10, 2017.
International Search Report and Written Opinion for PCT/EP2012/072204 dated Sep. 6, 2013.
International Written Opinion for International Application No. PCT/EP2012/072203, dated Sep. 6, 2013.
*Brushless DC electric motor*—Wikipedia, the free encyclopedia [online] [retrieved Nov. 19, 2013]. Retrieved from the Internet: <URL: http://en.wikipedia.org/wiki/Brushless_DC_electric_motor>. 1 page.
International Search Report and Written Opinion for Application No. PCT/EP2015/076184 dated Feb. 8, 2016, 13 pages.
International Search Report and Written Opinion for Application No. PCT/EP2015/077675 dated Aug. 16, 2016, 9 pages.
Notice of Allowance for U.S. Appl. No. 14/439,346 dated Sep. 20, 2017.
International Search Report and Written Opinion for International Application No. PCT/EP2016/053132 dated Nov. 9, 2016.

* cited by examiner

DETECTING OPERATIONAL STATE OF A DISHWASHER

CROSS REFERENCE TO RELATED APPLICATIONS

This application is a national stage application filed under 35 U.S.C. 371 of International Application No. PCT/EP2012/072203, filed Nov. 8, 2012, which is incorporated by reference herein in its entirety.

TECHNICAL FIELD

The present invention relates to a method of, and a device for, detecting an operational state of a dishwasher, in particular activation of extra wash zones and overfill situations.

BACKGROUND

Dishwashers in the art may be provided with special features for performing washing cycles other than the conventional. For instance, a dishwasher may be equipped with extra washing arms for locally washing and rinsing goods in a certain section of a washing compartment of the dishwasher. A user of the dishwasher may thus activate one or more extra washing zones in the washing compartment by manually lowering a foldable extra washing arm in the machine in order to clean goods located in the extra washing zone associated with the foldable washing arm. In order for the dishwasher to be alerted that the user manually has lowered the extra washing arm, so that the extra washing arm can be operated appropriately, a mechanical sensor or detector must be activated, an output of which is provided to the dishwasher for washing arm control.

A further special feature which dishwashers have been provided with in the art is overfill detection. Thus, in order to detect whether the washing compartment is filled with an excessive amount of process water, due to e.g. a faulty inlet valve or inferior water filling control, overfill sensors are required. Typically, the overfill sensors are embodied in the form of pressure sensors for determining amount of process water in the washing compartment.

Thus, in order to detect these operational states of prior art dishwashers, additional sensors are required.

SUMMARY

An object of the present invention is to solve, or at least mitigate this problem and provide detection of various operating states of a dishwasher without having to use the bulky and relatively expensive sensors employed in the art.

This objective is attained in a first aspect of the present invention by a device for detecting an operational state of a dishwasher. The device is arranged to operate a motor driving a dishwasher circulation pump at at least one rotational speed differing from a nominal rotational speed and measure operating current of the motor driving the dishwasher circulation pump. Further, the device is arranged to determine whether the dishwasher operates in an operational state differing from a nominal operational state based on the measured circulation pump motor operating current.

This object is attained in a second aspect of the present invention by a method of detecting an operational state of a dishwasher. The method comprises the steps of operating a motor driving a dishwasher circulation pump at at least one rotational speed differing from a nominal rotational speed and measuring operating current of the motor driving the dishwasher circulation pump. Further, the method comprises the step of determining whether the dishwasher operates in an operational state differing from a nominal operational state based on the measured circulation pump motor operating current.

Thus, an operational state of a dishwasher, such as e.g. extra wash zone activation or an overfill situation, is detected by means of operating a motor driving a circulation pump of the dishwasher such that a rotational speed of the motor, which differs from a nominal rotational speed, is achieved. Further, operating current of the dishwasher circulation pump motor is measured, and by analyzing the measured current, it can be determined whether the dishwasher operates in an operational state differing from a nominal operational state, where the nominal operational state corresponds to a normal washing cycle. The present invention is highly advantageous in that these different operational states of the dishwasher can be detected by appropriately operating the motor with regard to rotational speed, measuring the motor operating current and analyzing the measured current.

In terms of operating current; if there is a decrease in operating current of the circulation pump motor, the water level is adequate whereas if there is an increase in operating current, the water level is too high. Overfill of the washing compartment of the dishwasher can thus be detected by monitoring motor operating current, By measuring motor operating current, the load of the circulation pump is determined. Hence, the load of the circulation pump is easily and straightforwardly determined indirectly by measuring the voltage of a known shunt resistor in the motor and calculating the current by using Ohm's law. Measured current can be directly translated into circulation pump torque; the higher the torque, the higher the operating current of the motor driving the pump, and a higher pump torque implies a greater flow of process water through the circulation pump. Measuring circulation pump motor operating current is in itself advantageous as compared to using a relatively expensive pressure sensor to measure the flow of process water through the pump. Thus, as will be described in more detail in the following, activation of extra wash zone(s) as well as an overfill situation can be detected without using the previously discussed sensors employed in the art.

In an embodiment of the present invention, the motor driving the dishwasher circulation pump is operated at a rotational speed being lower than the nominal rotational speed (i.e. the rotational speed at which the motor is operating during a normal washing cycle). After having measured the motor operating current, it can be determined whether an extra wash zone has been activated based on a measured increase in circulation pump motor operating current. Thus, for a dishwasher with additional wash zones manually activated by the user, it is possible to automatically detect a washing arm activated in the additional zone by setting a working point of the circulation pump motor at a lower level than nominal (say from 3000 rpm to 1800 rpm). Thus, when starting the dishwasher, the circulation pump will typically be set to work at the lower rotational speed for a short while such that activation of the extra washing arm can be detected. That is, the motor driving the dishwasher circulation pump is typically operated at the lower rotational speed for a predetermined time period once at a beginning of a washing program. Activation of one or more extra washing arms effectively implies one or more nozzles spraying process water on goods to be cleaned. Additional nozzles spraying process water onto the goods will result in an additional amount of process water being circulated by the circulation pump, and the motor load/current will increase. When operating the motor at the lower rotational speed, which possibly is set at a lowest value required for rotating the washing arms of the dishwasher, the increase in motor load will be observable which may not the case when running the pump at nominal speed. Hence, the sensitivity of detecting variations in the operating current is increased. When the motor for driving the circulation pump is running at nominal speed, say about 3000 rpm typically being the rotational speed used for a normal washing cycle, it is less likely that an increased motor load is detected, which indicates activation of extra wash zones. By lowering the rotational speed of the motor down to about 1800 rpm, changes in circulation pump motor operating current are easier to detect, and it can be determined with higher accuracy whether the extra wash zones are activated or not. It can thus be determined that an additional wash zone indeed has been activated, and no extra sensors/switches are necessary for detecting this particular operating state of the dishwasher. If activation of an extra wash zone is detected, the dishwasher initiates a required action depending on washing program selected by the user.

In a further embodiment of the present invention, once one or more extra wash zones have been detected, the rotational speed of the motor driving the dishwasher circulation pump is increased to the nominal rotational speed imposed by a normal washing cycle.

In another embodiment of the present invention, the motor driving the dishwasher circulation pump is operated at a rotational speed being higher than the nominal rotational speed (i.e. the rotational speed at which the motor is operating during a normal washing cycle). After having measured the motor operating current, it can be determined whether the dishwasher is overfilled based on a measured increase in circulation pump motor operating current. Thus, for a dishwasher it is possible to automatically detect an overfill situation by setting a working point of the circulation pump motor at a higher level than nominal (say from 3000 rpm to 3200 rpm). When circulating the process water with a higher rate, it is possible to detect a situation where the level of process water in the dishwasher is too high. If the water level in the washing compartment is adequate, the increase in motor torque will produce air in the circulation pump, thereby decreasing motor load. If not, i.e. if the washing compartment contains an excess amount of process water, no air will be present in the pump, thereby increasing motor load which indicates an overflow situation. In terms of operating current; if there is a decrease in operating current of the circulation pump motor, the water level is adequate whereas if there is an increase in operating current, the water level is too high. Overfill of the washing compartment of the dishwasher can thus be detected by monitoring motor operating current, and overfill sensors can advantageously be avoided.

Advantageously, a faulty inlet valve can quickly be detected to avoid flooding. Further advantageous is that inferior water filling control can be detected and taken care of. According to embodiments of the present invention, depending on the type of overfill failure, different actions can be taken by the dishwasher. For instance, should the present overfill state be the result of a faulty inlet valve, the current washing cycle would be terminated and the fault could be indicated to the user by means of an indicator arranged in the dishwasher housing, e.g. in the form of a flashing warning lamp. On the other hand, should the overfill state be the result of inferior water filling control, it may not be necessary to terminate the current washing cycle, but an appropriate amount of excess process water could be drained from the washing compartment via a drain pump of the dishwasher until the compartment comprises an adequate level of water. It can be envisaged that the default action taken when dishwasher overfill is detected is to drain an appropriate amount of excess process water, and if the measured operating current subsequently is at an adequate level, the overfill was due to inferior water filling control and the current washing cycle can continue, whereas if the measured operating current still is at a high level, the overfill is due to a faulty inlet valve, and the current washing program is terminated.

In contrast to the embodiment of the present invention where activation of extra wash zones are detected, the overfill detection method according to embodiments of the present invention is not necessarily undertaken once at the beginning of a washing program, but rather undertaken repeatedly at selected intervals for continuously ensuring that the dishwasher is not overfilled.

In yet a further embodiment of the present invention, if it is determined that the dishwasher is not overfilled, the rotational speed of the motor driving the dishwasher circulation pump is decreased to the nominal rotational speed imposed by a normal washing cycle.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art.

Figure 1:
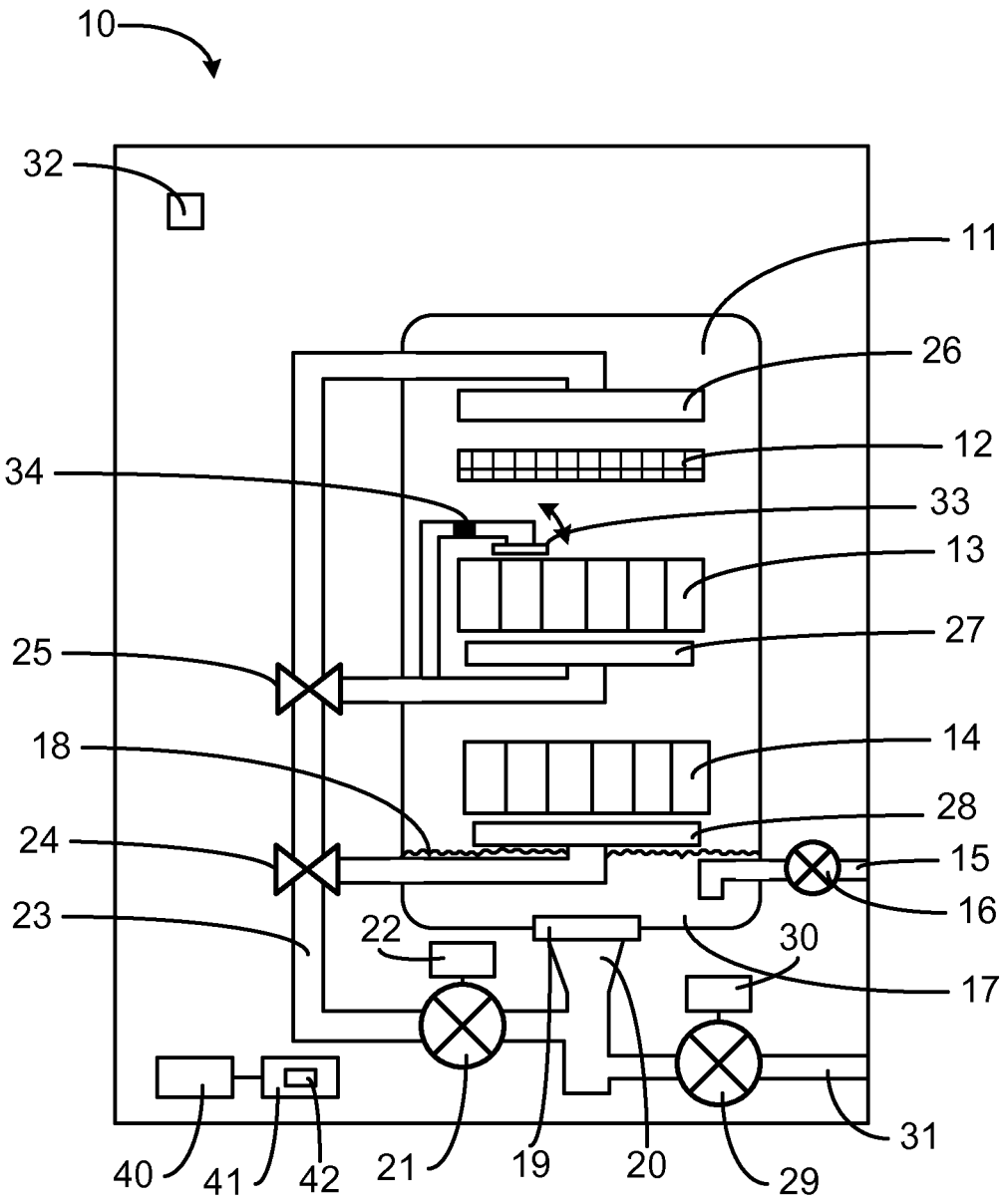
FIG. 1 shows a prior art dishwasher in which the present invention advantageously may be applied.

FIG. 1 shows a dishwasher to in which the present invention can be implemented. It should be noted that dishwashers can take on many forms and include many different functionalities. The dishwasher to illustrated in FIG. 1 is thus used to explain different embodiments of the present invention and should only be seen as an example of a dishwasher in which the present application can be applied. The dishwasher to comprises a washing compartment or tub 11 housing an upper basket 12, a middle basket 13 and a lower basket 14 for accommodating goods to be washed. Typically, cutlery is accommodated in the upper basket 12, while plates, drinking-glasses, trays, etc. are placed in the middle basket 13 and the lower basket 14.

Detergent in the form of liquid, powder or tablets is dosed in a detergent compartment located on the inside of a door (not shown) of the dishwasher 10 by a user, which detergent is controllably discharged into the washing compartment 11 in accordance with a selected washing programme. The operation of the dishwasher 10 is typically controlled by processing unit 40 executing appropriate software.

Fresh water is supplied to the washing compartment 11 via water inlet 15 and water supply valve 16. This fresh water is eventually collected in a so called sump 17, where the fresh water is mixed with the discharged detergent resulting in process water 18. At the bottom of the washing compartment is a filter 19 for filtering soil from the process water before the process water leaves the compartment via process water outlet 20 for subsequent re-entry into the washing compartment 11 through circulation pump 21. Thus, the process water 18 passes the filter 19 and is pumped through the circulation pump 21, which typically is driven by a brushless direct current (BLDC) motor 22, via a conduit 23 and respective process water valves 24, 25 and sprayed into the washing compartment 11 via nozzles (not shown) of a respective wash arm 26, 27, 28 associated with each basket 12, 13, 14. Thus, the process water 18 exits the washing compartment 11 via the filter 19 and is recirculated via the circulation pump 21 and sprayed onto the goods to be washed accommodated in the respective basket via nozzles of an upper washing arm 26, middle washing arm 27 and lower washing arm 28.

The washing compartment 11 of the dishwasher 10 is drained on process water 18 with a drain pump 29 driven by a BLDC motor 30. It should be noted that it can be envisaged that the drain pump 29 and the circulation pump 21 may be driven by one and the same motor.

Further, the dishwasher 10 comprises at least one extra washing arm 33 for creating an additional washing zone. The extra washing arm 33 is typically arranged with a flexible bellow 34 such that it can be folded from an inactive state into an active state (shown in FIG. 1).

Figure 2:
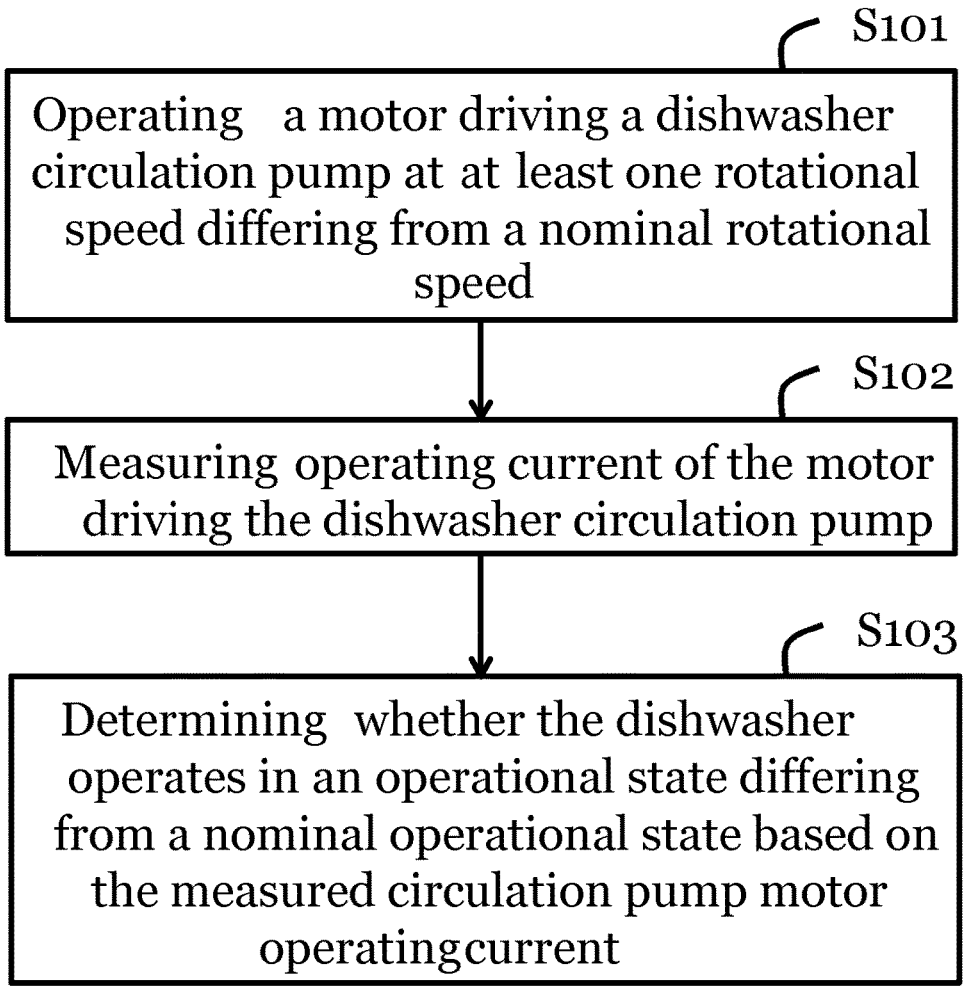
FIG. 2 shows a flowchart illustrating a method of detecting an operational state of the dishwasher according to an embodiment of the present invention.

FIG. 2 shows a flowchart illustrating a method of detecting an operational state of the dishwasher 10 according to an embodiment of the present invention. In a first step S101, the motor 22 driving the circulation pump 21 of the dishwasher 10 is operated at a rotational speed differing from a nominal rotational speed (i.e. the rotational speed at which the motor is operating during a normal washing cycle). In a second step S102, operating current of the motor 22 of the circulation pump 21 of the dishwasher 10 is measured, and by analyzing the measured current it can be determined in step S103 whether the dishwasher 10 operates in an operational state differing from a nominal operational state, where the nominal operational state corresponds to a normal washing cycle.

Figure 3:
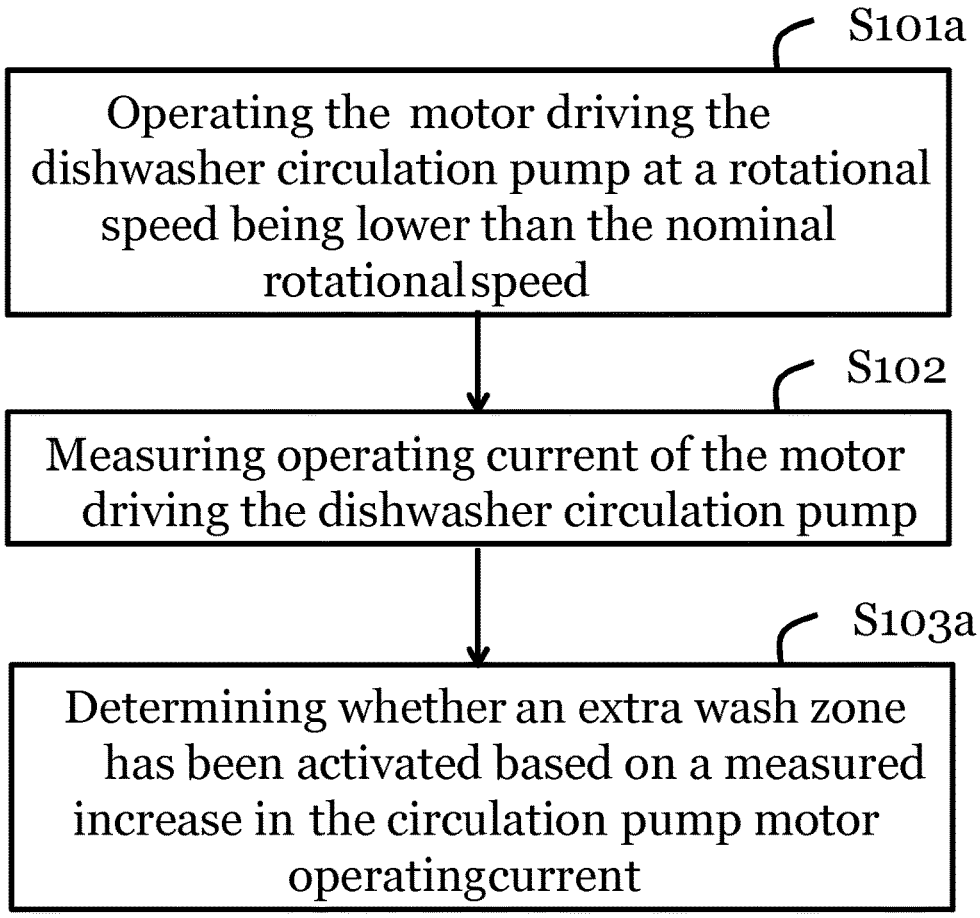
FIG. 3 shows a flowchart illustrating a method of detecting an operational state in the form of an activated extra wash zone of the dishwasher according to an embodiment of the present invention.

FIG. 3 shows a flowchart illustrating a method of detecting an operational state in the form of an activated extra wash zone of the dishwasher 10 according to an embodiment of the present invention. The motor 22 driving the dishwasher circulation pump 21 is operated in step S101*a* at a rotational speed being lower than the nominal rotational speed. After having measured the motor operating current in step S102, it can be determined in step S103*a* whether an extra wash zone has been activated by the extra washing arm 33 based on a measured increase in circulation pump motor operating current. Thus, a working point of the circulation pump motor 22 is set at a lower level than nominal (say from 3000 rpm to 1800 rpm), making it possible to detect one or more additional wash zones manually activated by the user, it is possible to automatically detect the activation of the extra washing arm 33. When starting the dishwasher 10, the circulation pump motor 22 will typically be set to work at the lower rotational speed for a short while such that activation of the extra washing arm 33 can be detected. Additional nozzles spraying process water 18 onto the goods will result in an additional amount of process water being circulated by the circulation pump 21, and the motor current will increase. The measured current may in an embodiment of the present invention be compared to an appropriately selected first predetermined current threshold value and if the measured current exceeds the first predetermined current threshold value, it is determined that the extra wash zone is considered to be activated. Thereafter, a required action depending on washing program selected by the user is initiated. Thus, the method of detecting activation of an extra wash zone is generally part of a normal washing cycle. Consequently, the rotational speed of the motor 22 driving the circulation pump 21 will be increased to the nominal rotational speed once the extra wash zone has been detected.

Figure 4:
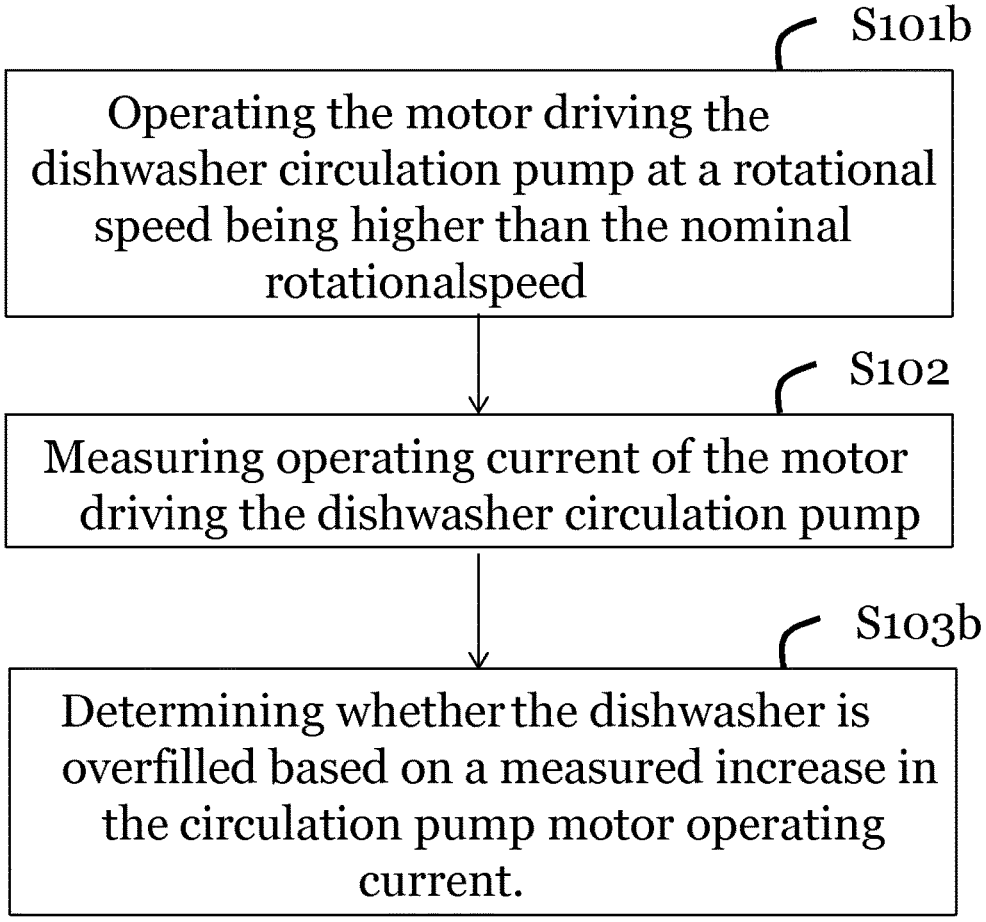
FIG. 4 shows a flowchart illustrating a method of detecting an operational state in the form of overfill of the dishwasher according to an embodiment of the present invention. The motor 22 driving the dishwasher circulation

FIG. 4 shows a flowchart illustrating a method of detecting an operational state in the form of overfill of the dishwasher to according to an embodiment of the present invention. The motor 22 driving the dishwasher circulation pump 21 is operated in step S101*b* at a rotational speed being higher than the nominal rotational speed. After having measured the motor operating current in step S102, it can be determined in step S103*b* whether the dishwasher to is overfilled based on a measured increase in circulation pump motor operating current. Thus, a working point of the circulation pump motor 22 is set at a higher level than nominal (say from 3000 rpm to 3200 rpm), making it possible, for the dishwasher 10 to automatically detect an overfill situation. Consequently, the circulation pump motor 22 will occasionally be set to work at the higher rotational speed thereby causing the circulation pump 21 to circulate the process water 18 with a higher rate. If the water level in the washing compartment is adequate, the increase in motor 22 torque will produce air in the circulation pump 21, thereby decreasing motor 22 load. If not, i.e. if the washing compartment 11 contains an excess amount of process water 18, no air will be present in the pump 21, thereby increasing motor load which indicates an overflow situation. As a result, if there is a decrease in operating current of the circulation pump motor 22, the water level is adequate whereas if there is an increase in operating current, the water level is too high. The measured current may in an embodiment of the present invention be compared to an appropriately selected second predetermined current threshold value and if the measured current exceeds the second predetermined current threshold value, it is determined that the dishwasher 10 is overfilled.

Should the dishwasher 10 not be overfilled, the rotational speed of the motor 22 driving the dishwasher circulation pump 21 is typically decreased to the nominal rotational speed and the current washing cycle is continued. Hence, the method of detecting an overfill situation is generally part of a normal washing cycle. However, in contrast to the method of detecting activation of extra wash zones, the overfill detection is typically performed repeatedly during a normal washing cycle. It should further be noted that overfill detection according to embodiments of the present invention could be implemented in dishwashers lacking extra wash zones. It can further be envisaged that a separate short overfill detection program is run to test whether overfill problems are present in the dishwasher 10.

However, should the dishwasher 10 be overfilled, precautionary actions are taken. In one embodiment of the present invention, the washing compartment 11 of the dishwasher 10 is drained on an appropriate amount of excess process water 18 such that the circulation pump 21 circulates the correct amount of process water. This can be determined by repeating the method of detecting overfill according to embodiments of the present invention. The overfill state could in this example be the result of inferior water filling control.

In another embodiment, if the overfill cannot be overcome by draining the washing compartment 11 of the dishwasher 10 on an appropriate amount of excess process water 18, the overfill state is most likely due to a faulty inlet valve and to avoid flooding, the current washing cycle is terminated. In still another embodiment, a user of the dishwasher 10 is given an indication that the washing compartment 11 is overfilled and that the current washing cycle is terminated, for example visually via a diode 32 in the dishwasher housing or audibly via a sound indication. The user may subsequently send for service personnel to repair the faulty inlet valve.

The controlling of the dishwasher 10 with respect to supervising washing programmes selected by a user, controlling circulation and draining of process water 18 via the circulation pump 21 and the drain pump 29, discharging detergent, effecting rotation of wash arms 26, 27, 28, 33, controlling actuation of water valves 16, 24, 25, etc. as well as controlling the motor 22 of the circulation pump 21 according to different embodiments of the method of the present invention is managed by the processing unit 40 via drive means such as the two BLDC motors 22, 30 and via further mechanical structures (not shown) for opening the detergent compartment, rotating the washing arms, actuating the water valves, etc. Thus, the processing unit 40 is communicatively coupled to various hardware elements in the dishwasher 10, such as the motor 22 of the circulation pump 21. The processing unit 40 is typically embodied e.g. in the form of one or more microprocessors arranged to execute a computer program 42 downloaded to a suitable storage medium 41 associated with the microprocessor, such as a RAM, a Flash memory or a hard disk. The microprocessor 40 is arranged to at least partly carry out the method according to embodiments of the present invention when the appropriate computer program 42 comprising computer-executable components is downloaded to the memory 41 and executed by the microprocessor 40. The storage medium 41 may be a computer program product comprising the computer program 42. Alternatively, the computer program 42 may be transferred to the storage medium 41 by means of a suitable computer program product, such as a memory stick, or even over a network. The microprocessor 40 may alternatively be embodied in the form of an application specific integrated circuit (ASIC), a field-programmable gate array (FPGA), a complex programmable logic device (CPLD), etc.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A method of detecting an operational state of a dishwasher, the dishwasher comprising a dishwasher circulation pump, the dishwasher being configured to operate at least a first washing cycle, wherein (a) during the first washing cycle the circulation pump is caused to be operated at a first rotational speed and (b) the first washing cycle corresponds to a first operational state, the method comprising the steps of:

causing operation of a motor driving the dishwasher circulation pump to operate the dishwasher circulation pump at a second rotational speed, the second rotational speed differing from the first rotational speed;

measuring operating current of the motor driving the dishwasher circulation pump in response to causing operation of the motor driving the dishwasher circulation pump at the second rotational speed;

determining whether the dishwasher operates in a second operational state differing from the first operational state based on the measured circulation pump motor operating current at the second rotational speed, wherein the second rotational speed is selected based on a change in operating current of the motor being more easily detected at the second rotational speed than at the first rotational speed.

2. The method of claim 1, wherein the step of operating a motor driving a dishwasher circulation pump comprises:

operating the motor driving the dishwasher circulation pump at the second rotational speed, wherein the second rotational speed is lower than the first rotational speed; and the step of determining operational state comprises:

determining whether an extra wash zone has been activated based on a measured increase in the circulation pump motor operating current.

3. The method of claim 2, said motor driving the dishwasher circulation pump being operated at the second rotational speed for a predetermined time period at a beginning of a washing program.

4. The method of claim 3, further comprising the step of:

increasing the rotational speed of the motor driving the dishwasher circulation pump to the first rotational speed in response to (a) detecting that the extra wash zone has been activated or (b) after the predetermined time period elapses and activation of the extra wash zone has not been detected.

5. The method of claim 2 wherein the step of determining whether an extra wash zone has been activated based on the measured increase in circulation pump motor operating current comprises:

comparing the measured circulation pump motor operating current to a first predetermined current threshold value, wherein the extra wash zone is considered to be activated if the measured current exceeds the first predetermined current threshold value.

6. The method of claim 2, further comprising the step of:

initiating, if activation of an extra wash zone is detected, an action selected based on a washing program selected by the user.

7. The method of claim 1, wherein the step of operating a motor driving a dishwasher circulation pump comprises:

operating the motor driving the dishwasher circulation pump at the second rotational speed being higher than the first rotational speed; and the step of determining operational state comprises:

determining whether the dishwasher is overfilled based on a measured increase in the circulation pump motor operating current, wherein the dishwasher is overfilled when the amount of processing water within a washing compartment of the dishwasher is in excess of an amount of processing water within the washing compartment during a normal washing cycle.

8. The method of claim 7, further comprising the step of:

decreasing the rotational speed of the motor driving the dishwasher circulation pump to the first rotational speed if it is determined that the dishwasher is not overfilled.

9. The method of claim 7, wherein the step of determining whether the dishwasher is overfilled based on a measured increase in circulation pump motor operating current comprises:

comparing the measured circulation pump motor operating current to a second predetermined current threshold value, wherein the dishwasher is considered to be overfilled if the measured current exceeds the second predetermined current threshold value.

10. The method of claim 7, further comprising the step of:

draining the dishwasher of an appropriate amount of excess process water if it is determined that the dishwasher is overfilled.

11. The method of claim 10, further comprising the step of:

after draining the appropriate amount of excess process water, determining if the dishwasher is overfilled; and terminating a current washing cycle if it is determined that the dishwasher is overfilled after draining the dishwasher of the appropriate amount of excess process water.

12. The method of claim 7, further comprising the step of:

signaling, via an indicator of the dishwasher, that the dishwasher is overfilled if it is determined that the dishwasher is overfilled.

* * * * *